US012616279B2

(12) United States Patent
Fukuhara et al.

(10) Patent No.: US 12,616,279 B2
(45) Date of Patent: May 5, 2026

(54) SURFACE FASTENER

(71) Applicant: YKK Corporation, Tokyo (JP)

(72) Inventors: Yoshiyuki Fukuhara, Toyama (JP); Takuya Nozaki, Toyama (JP)

(73) Assignee: YKK Corporation, Tokyo (JP)

( * ) Notice: Subject to any disclaimer, the term of this patent is extended or adjusted under 35 U.S.C. 154(b) by 40 days.

(21) Appl. No.: 18/687,382

(22) PCT Filed: Dec. 10, 2021

(86) PCT No.: PCT/JP2021/045603
§ 371 (c)(1),
(2) Date: Feb. 28, 2024

(87) PCT Pub. No.: WO2023/105774
PCT Pub. Date: Jun. 15, 2023

(65) Prior Publication Data

US 2024/0349847 A1 Oct. 24, 2024

(51) Int. Cl.
*A44B 18/00* (2006.01)

(52) U.S. Cl.
CPC ..... *A44B 18/0049* (2013.01); *A44B 18/0065* (2013.01)

(58) Field of Classification Search
CPC ..... A44B 18/0049; A44B 18/0065; A44B 18/0019; A44B 18/0046; A44B 18/0053; A44B 18/0057; A44B 18/0061
See application file for complete search history.

(56) References Cited

U.S. PATENT DOCUMENTS 5,860,194 A * 1/1999 Takizawa ..... A44B 18/0049 24/442
6,627,133 B1 * 9/2003 Tuma ..... B29C 67/0044 264/214

(Continued)

FOREIGN PATENT DOCUMENTS

JP 2014-533164 A 12/2014
WO 2017/109902 A1 6/2017
WO WO-2020100282 A1 * 5/2020 ..... B29C 43/24

OTHER PUBLICATIONS

International Preliminary Report on Patentability, PCT Patent Application No. PCT/JP2021/045603, Jun. 20, 2024, 12 pages.
Third-Party Submission Under 37 CFR 1.290, Apr. 22, 2025, 12 pages.
Affidavit of Dr. Lars Heepe, Apr. 17, 2025, 5 pages.
Exhibit A to Affidavit of Dr. Lars Heepe dated Apr. 17, 2025, Screenshot, 1 page.

(Continued)

*Primary Examiner* — Jason W San
*Assistant Examiner* — Rowland Do
(74) *Attorney, Agent, or Firm* — Kilpatrick Townsend & Stockton LLP

(57) ABSTRACT

A surface fastener includes a base portion and a plurality of engaging elements, the base portion and the engaging elements include a thermoplastic resin at least partially including a plant-derived resin, the plant-derived resin has an MFR of 5 g/10 min or more and 30 g/10 min or less, and has a flexural modulus of 800 MPa or more and 2300 MPa or less, and, in plan view of each of the engaging elements, the engaging head portion is such that at least a part of the engaging head portion has a shape protruding outward with respect to an upper end of the stem portion. Therefore, the surface fastener can include a plurality of engaging elements. In addition, compared to the related art, it is possible to reduce the use of fossil-resource-derived resin to thereby reduce the load on the environment.

6 Claims, 4 Drawing Sheets

(56) References Cited

U.S. PATENT DOCUMENTS

| | | | | |
|---|---|---|---|---|
| 11,470,922 | B2 * | 10/2022 | Michihata | A44B 18/00 |
| 2005/0202205 | A1 * | 9/2005 | Petersen | B29C 43/222 428/100 |
| 2007/0063375 | A1 * | 3/2007 | Tuma | A44B 18/0065 264/166 |
| 2011/0160687 | A1 * | 6/2011 | Welch | B32B 38/04 428/137 |
| 2013/0067702 | A1 * | 3/2013 | Tuma | A44B 18/0073 24/450 |
| 2015/0010732 | A1 * | 1/2015 | Tuma | B29C 33/0027 428/156 |
| 2015/0074956 | A1 | 3/2015 | Aplix | |
| 2017/0156451 | A1 * | 6/2017 | Cheng | A44B 18/0065 |
| 2018/0360170 | A1 * | 12/2018 | Fukuhara | A44B 18/0073 |
| 2019/0008239 | A1 * | 1/2019 | Fukuhara | A44B 18/0007 |
| 2019/0298880 | A1 * | 10/2019 | Yamaki | C08K 3/26 |
| 2020/0305558 | A1 * | 10/2020 | Takekawa | A44B 18/0049 |
| 2022/0039521 | A1 | 2/2022 | Fukuhara et al. | |

OTHER PUBLICATIONS

Exhibit B to Affidavit of Dr. Lars Heepe dated Apr. 17, 2025, Screenshot, 1 page.
Exhibit C to Affidavit of Dr. Lars Heepe dated Apr. 17, 2025, photograph, 1 page.
Exhibit D to Affidavit of Dr. Lars Heepe dated Apr. 17, 2025, brochure, 6 pages.
Exhibit E to Affidavit of Dr. Lars Heepe dated Apr. 17, 2025, Data Sheet, 2 pages.
International Search Report, PCT Patent Application No. PCT/JP2021/045603, Feb. 15, 2022, 5 pages.
Written Opinion, PCT Patent Application No. PCT/JP2021/045603, Feb. 15, 2022, 4 pages.
The Notarized Affidavit of Dr. Lars Heepe includes Exhibit D which was a marketing brochure passed out at the Hygienix fair in Scottsdale, Arizona during Nov. 15-18, 2021. Exhibit D is the non-patent publication entered as prior art.†

* cited by examiner
† cited by third party

SURFACE FASTENER

TECHNICAL FIELD

The present invention relates to a surface fastener and a method of manufacturing a surface fastener.

BACKGROUND ART

Surface fasteners are currently widely used in various products, and are also frequently used in, for example, disposable diapers, diaper covers for infants, supporters that protect hand and foot joints or the like, waist corsets (belts for lower back pain), and products that are attachable to and detachable from the body, such as gloves. In addition, surface fasteners of the related art are generally made of fossil-resource-derived synthetic resins.

In recent years, interest in various problems, such as environmental problems, is increasing, and measures are being taken to achieve sustainable development goals. As one measure, with regard to the use of fossil-resource-derived resins, problems are being pointed out, such as the generation of greenhouse gases, environmental pollution caused by disposed waste, and the dangers of depletion of fossil resources. Therefore, instead of fossil-resource-derived resins, the use of plant-derived resins (may also be called "biomass-derived resins") whose raw material is a renewable biological resource or the use of biodegradable resins is being considered. The capability of manufacturing plant-derived resins and biodegradable resins is inferred to improve every year.

For example, Japanese Unexamined Patent Application Publication (Translation of PCT Application) No. 2014-533164 (PTL 1) discloses that, with regard to the material of which a hook fastener is made, renewable biomass-derived bioplastics, such as cellulose or biopolymer, may be used.

CITATION LIST

Patent Literature

PTL 1: Japanese Unexamined Patent Application Publication (Translation of PCT Application) No. 2014-533164

SUMMARY OF INVENTION

Technical Problem

Although PTL 1 exemplifies bioplastics as the material of a hook fastener, PTL 1 does not give any detailed information about, for example, the physical properties of bioplastics required for forming a hook fastener and the processing conditions of bioplastics.

For example, as a synthetic resin of which a surface fastener is made, mixing a plant-derived resin or a biodegradable resin with a fossil-resource-derived resin and using this mixture is also being considered. However, in this case, due to, for example, the differences between the physical properties of the plant-derived resin or the physical properties of the biodegradable resin and the physical properties of the fossil-resource-derived resin, engaging elements of the surface fastener cannot be molded into a proper shape when two different types of resins are simply mixed.

The present invention has been made in view of the problems above, and it is an object of the present invention to provide a surface fastener that can be formed by using a plant-derived resin and that includes a plurality of engaging elements engageable with loop members or the like, and a manufacturing method of manufacturing the surface fastener.

Solution to Problem

To this end, a surface fastener provided by the present invention is a surface fastener including: a base portion and a plurality of engaging elements that are provided on one surface of the base portion, each engaging element including a stem portion that extends upward from the base portion and an engaging head portion that is integrally formed with an upper end of the stem portion, in which the base portion and the engaging elements include a thermoplastic resin that at least partially includes a plant-derived resin, the plant-derived resin has a melt flow rate of 5 g/10 min or more and 30 g/10 min or less, and a flexural modulus of 800 MPa or more and 2300 MPa, and, in plan view of each of the engaging elements, the engaging head portion is such that at least a part of the engaging head portion has a shape that protrudes outward with respect to the upper end of the stem portion.

It is preferable that, in the surface fastener of the present invention, each of the engaging head portions have a head-portion top end surface that faces upward, an outer peripheral side surface that inclines or curves downward from an outer peripheral edge of the head-portion top end surface, and a head-portion rear surface that is disposed between the outer peripheral side surface and the upper end of the stem portion: and a rear surface angle between a portion of the head-portion rear surface that extends from the upper end of the stem portion and an imaginary line that is extended downward from the upper end of the stem portion be less than or equal to 120 degrees.

It is preferable that the thermoplastic resin include plant-derived polyethylene by a proportion of 25 parts by weight to 100 parts by weight with respect to 100 parts by weight of the thermoplastic resin.

It is preferable that the thermoplastic resin be formed from a mixture of plant-derived polyethylene and fossil-resource-derived polypropylene: the plant-derived polyethylene be included in the thermoplastic resin by a proportion of greater than or equal to 25 parts by weight and less than 100 parts by weight with respect to 100 parts by weight of the thermoplastic resin: and the fossil-resource-derived polypropylene have a melt flow rate of 5 g/10 min or more and 60 g/10 min or less, and a flexural modulus of 600 MPa or more and 2300 MPa or less.

It is preferable that, in the surface fastener of the present invention, each of the engaging elements be provided with at least one very small pawl portion that protrudes from an outer peripheral edge portion of the engaging head portion. In this case, it is preferable that the at least one very small pawl portion extend downward toward the base portion from the outer peripheral edge portion of the engaging head portion corresponding thereto.

Next, a method of manufacturing a surface fastener that is provided by the present invention is a manufacturing method of manufacturing a surface fastener including a base portion and a plurality of engaging elements that are provided on one surface of the base portion, each engaging element including a stem portion that extends upward from the base portion and an engaging head portion that is integrally formed with an upper end of the stem portion, the method including: a primary molding step of, by melting and supplying a material that includes a thermoplastic resin at least partially including a plant-derived resin, molding a primary molded body that includes the base portion and a plurality of primary elements provided on one surface of the base portion: and a secondary molding step of, by pressing and deforming at least a part of each of the primary elements, molding each of the engaging elements in which at least a part of the engaging head portion protrudes outward with respect to the upper end of the stem portion in plan view, in which the secondary molding step includes using a secondary molding device that includes at least an upper roller including a heating source: heating the primary elements and pressing the primary elements from thereabove by bringing the upper roller into contact with the primary elements: and setting a heating temperature of the upper roller to be lower than or equal to a temperature that is 18° C. lower than a temperature in which a weighted average of melting points of respective synthetic resins included in the thermoplastic resin is obtained.

It is preferable that the method of manufacturing a surface fastener include setting the heating temperature of the upper roller in the secondary molding step to be higher than or equal to a temperature that is 35° C. lower than the temperature in which the weighted average of the melting points of the respective synthetic resins included in the thermoplastic resin is obtained.

It is preferable that the manufacturing method of the present invention include causing the thermoplastic resin to include plant-derived polyethylene by a proportion of 25 parts by weight to 100 parts by weight with respect to 100 parts by weight of the thermoplastic resin.

It is preferable that the manufacturing method of the present invention include forming the thermoplastic resin from a mixture of plant-derived polyethylene and fossil-resource-derived polypropylene.

It is preferable that the manufacturing method of the present invention include the primary molding step of molding the primary molded body by using a die wheel including an outer cylindrical body that is provided with a plurality of through holes extending from an outer peripheral surface to an inner peripheral surface of the outer cylindrical body and an inner cylindrical body that is disposed in close contact with the inner peripheral surface of the outer cylindrical body, the die wheel being such that a plurality of recessed portions are provided in an outer peripheral surface of the inner cylindrical body, the die wheel having a portion where outer peripheral edges of at least a part of the through holes in the inner peripheral surface of the outer cylindrical body overlap the recessed portions of the inner cylindrical body.

In this case, it is preferable that the manufacturing method of the present invention include in the primary molding step, molding the primary elements, each including at least a primary stem portion that is formed by the through hole of the outer cylindrical body and a primary very small pawl portion that is formed by the recessed portion of the inner cylindrical body: and in the secondary molding step, forming, from the primary very small pawl portions, very small pawl portions that protrude from the engaging head portions.

Advantageous Effects of Invention

According to the present invention, it is possible to provide a surface fastener that is formed by using a plant-derived resin and that includes a plurality of engaging elements engageable with loop members or the like, and a manufacturing method of manufacturing the surface fastener.

DESCRIPTION OF EMBODIMENTS

A preferred embodiment of the present invention is described in detail below with reference to the drawings. Note that the present invention is not limited in any way to the embodiment described below, and various changes can be made as long as structures are substantially the same as those of the present invention and similar operational effects are provided. For example, in the embodiment below, for example, the number, the size (the thickness and the height), and the formation density of engaging elements that are provided on a base portion of a surface fastener are not particularly limited and are changeable.

Figure 1:
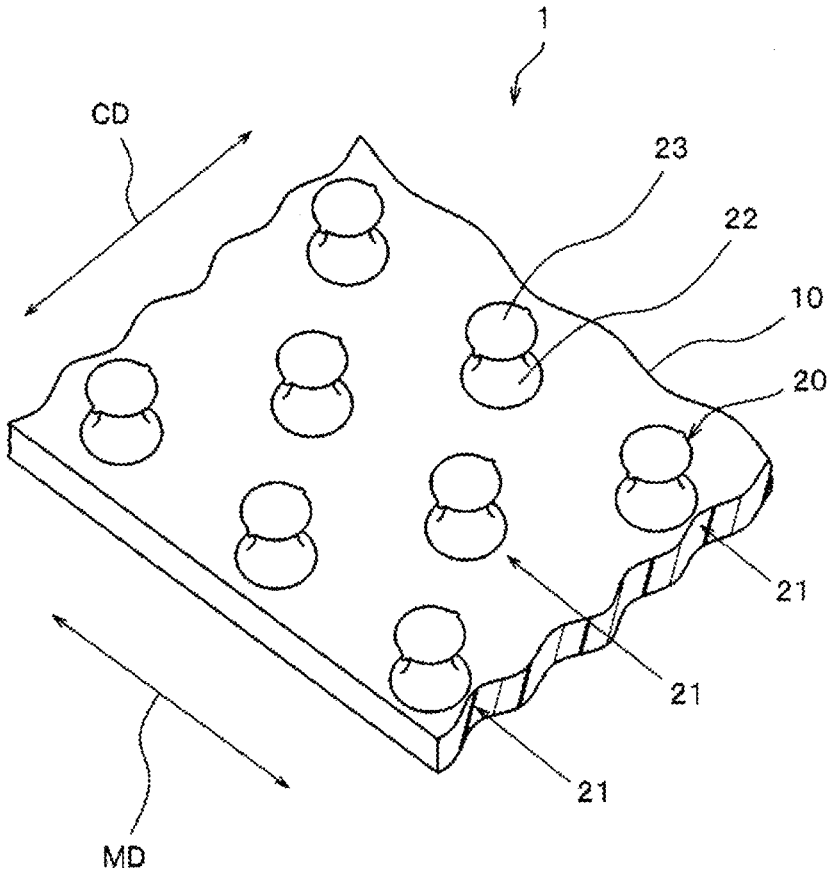
FIG. 1 is a perspective view showing a surface fastener according to an embodiment of the present invention.
Figure 2:
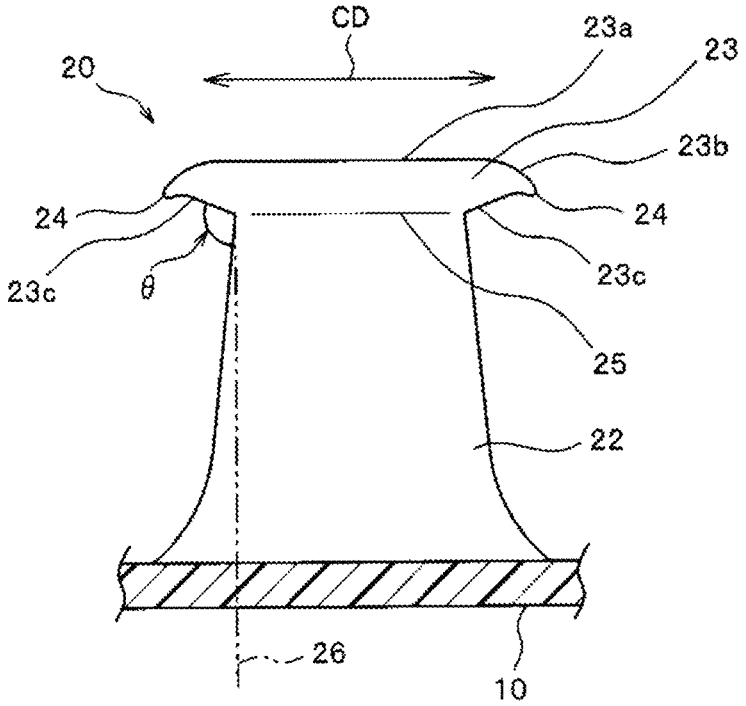
FIG. 2 is a front view of an engaging element of the surface fastener shown in FIG. 1 as seen from a machine direction.

FIG. 1 is a perspective view showing a surface fastener according to the embodiment. FIG. 2 is a front view of an engaging element of the surface fastener as seen from a machine direction.

Note that, in the description below, a front-rear direction is a length direction of a surface fastener 1 molded to be long and a primary molded body 30. The front-rear direction is a direction along a machine direction MD in which the surface fastener 1 or the primary molded body 30 is transported in a manufacturing process of the surface fastener 1.

A left-right direction is orthogonal to the length direction and refers to a width direction along a flat upper surface (first surface) of a base portion 10 of the surface fastener 1. In this case, the left-right direction and the width direction are each a direction along an orthogonal direction CD orthogonal to the machine direction MD.

An up-down direction is a height direction (or a thickness direction of the base portion 10) along a direction orthogonal to the flat upper surface of the base portion 10, or is a direction orthogonal to the front-rear direction and the left-right direction. In this case, a side toward which engaging elements 20 protrude with respect to the base portion 10 is an upper side, and an opposite side is a lower side.

As described below, by using a manufacturing apparatus 40, shown in FIG. 3, including a primary molding device 50 and a heating pressing device (secondary molding device) 60, the surface fastener 1 according to the present embodiment is manufactured to have a rectangular shape that is long in the machine direction MD of the manufacturing apparatus 40 in plan view of the surface fastener 1. Note that a length dimension (dimension in the machine direction MD) and a width dimension (dimension in the orthogonal direction CD)

of the surface fastener 1 are not particularly limited, and can be changed to any values by, for example, cutting the surface fastener 1. The surface fastener 1 may have a shape other than a rectangular shape in plan view.

The surface fastener 1 of the present embodiment is made of a thermoplastic resin that includes a plant-derived resin. Specifically, in the present embodiment, the thermoplastic resin of which the surface fastener 1 is made is a mixture of the plant-derived resin and a fossil-resource-derived resin. For the plant-derived resin and the fossil-resource-derived resin, types of synthetic resins differing from each other are used. For example, for the plant-derived resin, plant-derived polyethylene is preferably used. In recent years, plant-derived polyethylene has been stably manufactured and supplied, and thus can be relatively easily obtained. Progress is being made in the development of plant-derived polyethylene, and various types of plant-derived polyethylene having, for example, different densities and forms are being sold. Therefore, the material can be selected with greater freedom. For the fossil-source-derived resin, petroleum-derived polypropylene is preferably used. Note that, instead of petroleum-derived polypropylene, natural-gas-derived polypropylene may be used.

Here, the plant-derived resin is a synthetic resin that can be obtained by using a biologically derived resource as a raw material, and is sometimes called biomass plastic. Whether or not the synthetic resin is a plant-derived resin or a fossil-resource-derived resin can be determined by performing a measurement based on ASTM D6866. Further, it is possible to also obtain the proportion of the plant-derived resin included in the synthetic resin.

In the thermoplastic resin in which the plant-derived polyethylene and the petroleum-derived polypropylene are mixed, when the thermoplastic resin, which is this mixture, is defined as being 100 parts by weight, the plant-derived polyethylene is included by a proportion of greater than or equal to 25 parts by weight and less than 100 parts by weight. The petroleum-derived polypropylene is included by a proportion of greater than 0 parts by weight and less than or equal to 75 parts by weight. For example, in the present embodiment, the thermoplastic resin of which the surface fastener 1 is made includes 50 parts by weight of the plant-derived polyethylene and 50 parts by weight of the petroleum-derived polypropylene.

Note that, in the present invention, for the plant-derived resin, a resin other than the plant-derived polyethylene may be used. For the petroleum-derived resin, a resin other than the petroleum-derived polypropylene may be used. The thermoplastic resin of which the surface fastener 1 is made may include only the plant-derived resin (100 parts by weight of the plant-derived resin) instead of being formed from the mixture of the plant-derived resin and the fossil-resource-derived resin.

Regarding the material of the surface fastener 1, the plant-derived resin (in the present embodiment, the plant-derived polyethylene) included in the thermoplastic resin has a melt flow rate (hereunder may be abbreviated as MFR) of 5 g/10 min or more and 30 g/10 min or less, and a flexural modulus of 800 MPa or more and 2300 MPa or less. The fossil-resource-derived resin (in the present embodiment, the petroleum-derived polypropylene) included in the thermoplastic resin has an MFR of 5 g/10 min or more and 60 g/10 min or less, and a flexural modulus of 600 MPa or more and 2300 MPa or less. Note that the range of the MFR of the plant-derived resin above indicates numerical values when a measurement temperature is 190° C. The range of the MFR of the fossil-resource-derived resin above indicates numerical values when a measurement temperature is 230° C.

The surface fastener 1 of the present embodiment includes the base portion 10 that is thin and that is flat-plate-shaped, and the plurality of engaging elements 20 that are provided on the upper surface of the base portion 10. The base portion 10 is formed to be long along the machine direction MD in a manufacturing process of the surface fastener 1. The base portion 10 has a predetermined thickness that allows a proper strength to be obtained. The base portion 10 has the flat upper surface (first surface) and a flat lower surface (second surface) disposed on a side opposite to the upper surface, and the upper surface and the lower surface of the base portion 10 are formed parallel to each other.

The plurality of engaging elements 20 are provided so as to be regularly arrayed in a staggered arrangement pattern on the upper surface of the base portion 10. To describe specifically, the engaging elements 20 are disposed at a fixed pitch (interval) along the front-rear direction, and thus engaging element rows 21 are formed. The plurality of engaging element rows 21 are disposed at a fixed interval in the left-right direction. With regard to the engaging element rows 21 that are adjacent to each other in the left-right direction, the plurality of engaging elements 20 are arranged in a staggered manner or a zigzag manner by displacing the positions of the engaging elements by a ½ pitch in the front-rear direction. Note that in the present invention, the arrangement of the engaging elements 20 is not particularly limited, and, for example, the plurality of engaging elements 20 may be arranged in a lattice arrangement pattern in which the plurality of engaging elements 20 are arrayed in the front-rear direction and the left-right direction, or may be randomly arranged.

Each engaging element 20 includes a stem portion 22 that extends upward from the upper surface of the base portion 10, a disk-shaped or dish-shaped engaging head portion 23 that is integrally formed with an upper end of the stem portion 22, and two very small pawl portions 24 that protrude outward by a small amount from an outer peripheral edge portion of the engaging head portion 23.

Each stem portion 22 protrudes upward from the upper surface of the base portion 10. Each stem portion 22 has a truncated conical shape whose area of a cross section orthogonal to the up-down direction gradually increases with decreasing distance to the base portion 10, or a substantially truncated conical shape that is close to the truncated conical shape. Note that, in the present invention, the shape of each stem portion 22 is not limited to a truncated conical shape or a substantially truncated conical shape, and may be, for example, a truncated pyramidal shape, such as a square truncated pyramidal shape, a circular columnar shape, a prismatic shape, such as a rectangular prismatic shape, or a shape close to any of these shapes.

Each engaging head portion 23 is integrally formed on the stem portion 22 with a boundary portion 25 interposed therebetween. In this case, each boundary portion 25 between the stem portion 22 and the engaging head portion 23 is stated differently a bending portion of the engaging element 20 or the upper end of the stem portion 22. Each engaging head portion 23 is formed to have a relatively small thickness (dimension in the up-down direction), and has a circular shape in plan view when the engaging element 20 is seen from an upper side.

In plan view of each engaging element 20, a circle that is formed by an outer peripheral edge of the engaging head portion 23 has a diameter that is larger than the diameter of a circle formed by the boundary portion 25, or includes the circle of the boundary portion 25 on an inner side in a radial direction. In the present embodiment, in an entire periphery of the boundary portion 25, the engaging head portion 23 has a shape that protrudes outward in a radial direction of the engaging head portion 23 from the boundary portion 25. Note that, in the present invention, the engaging head portion may be formed such that only a part of the engaging head portion protrudes outward in the radial direction of the engaging head portion from the boundary portion.

As shown in FIG. 2, each engaging head portion 23 has a head-portion top end surface 23*a* that faces upward, an outer peripheral side surface 23*b* that inclines or curves downward from an outer peripheral edge of the head-portion top end surface 23*a*, and a head-portion rear surface 23*c* that extends toward the outer peripheral side surface 23*b* from the boundary portion 25. The head-portion top end surface 23*a* of each engaging head portion 23 includes a flat surface disposed parallel or substantially parallel to the upper surface of the base portion 10. Each head-portion rear surface 23*c* is disposed between the boundary portion 25 and the outer peripheral side surface 23*b* of the engaging head portion 23. The outer peripheral side surface 23*b* of each engaging head portion 23 is formed over the entire engaging head portion 23 in a peripheral direction between the head-portion top end surface 23*a* and the head-portion rear surface 23*c*.

Each head-portion rear surface 23*c* is disposed on a rear side (opposite side in the up-down direction) of the head-portion top end surface 23*a* of the engaging head portion 23 so as to face the base portion 10. Each head-portion rear surface 23*c* is formed in a plane or substantially in a plane when the corresponding engaging element 20 is seen from a direction orthogonal to the up-down direction. Note that when the engaging element 20 is seen in the direction orthogonal to the up-down direction, the corresponding head-portion rear surface 23*c* may be formed as a curved surface or a substantially curved surface. Each head-portion rear surface 23*c* has a doughnut shape or a ring shape that surrounds the corresponding stem portion 22.

Here, when each engaging element 20 is seen from the direction orthogonal to the up-down direction (see FIG. 2), and when an imaginary line 26 is extended along the up-down direction downward from the boundary portion 25 of the engaging element 20, an angle between the imaginary line 26 and a portion of the head-portion rear surface 23*c* that extends from the boundary portion 25 is defined as a rear surface angle θ. Each engaging head portion 23 of the present embodiment has a shape in which the rear surface angle θ of the head-portion rear surface 23*c* is less than or equal to 120 degrees.

When the rear surface angle θ is less than or equal to 120 degrees (preferably, less than or equal to 90 degrees), loops of loop members of a nonwoven fabric or the like can be easily caught by rear sides of the engaging head portions 23. It is possible to, by easily holding the loops caught by the engaging head portions 23, suppress the loops from being easily separated from the engaging elements 20. Therefore, the surface fastener 1 can easily be provided with a high engaging strength (peel strength) with respect to the loop members. The rear surface angle θ is preferably greater than or equal to 70 degrees. Therefore, the loops of the loop members can easily move to the rear sides of the engaging head portions 23.

Note that, in the present invention, the rear surface angle θ of each engaging element 20 is not particularly limited. Each engaging element 20 preferably has a shape in which the rear surface angle θ in at least a part of the engaging head portion 23 becomes less than or equal to 120 degrees, and more preferably has a shape in which the rear surface angle θ becomes less than or equal to 120 degrees over the entire periphery of the engaging head portion 23.

Each engaging element 20 is provided with two very small pawl portions 24 on the left and the right that protrude outward from the outer peripheral edge portion of the engaging head portion 23. In plan view of each engaging element 20, the left and right very small pawl portions 24 are disposed in a point-symmetrical positional relationship with respect to each other, and protrude outward in the radial direction of the engaging head portion 23 from the engaging head portion 23. In the case of the present embodiment, the left and right very small pawl portions 24 protrude in opposite directions with respect to each other along the left-right direction (diametrical direction CD) from the engaging head portion 23.

In each engaging head portion 23, the outer peripheral edge portion of the head-portion top end surface 23*a* has a region that is connected to the very small pawl portions 24 and a region that is connected to the outer peripheral side surface 23*b*. In the region in which each head-portion top end surface 23*a* is connected to the very small pawl portions 24, each head-portion top end surface 23*a* is connected to the very small pawl portions 24, and the very small pawl portions 24 are connected to the head-portion rear surface 23*c* formed below the very small pawl portions 24. Each head-portion rear surface 23*c* is connected to an entire periphery of the outer peripheral edge portion of the stem portion 22 at the boundary portion 25. In this way, as long as the region in which the very small pawl portions 24 are formed at the outer peripheral edge portion of each engaging head portion 23 and a region in which very small pawl portions 24 are not formed are disposed, the number of very small pawl portions 24 is not limited.

As shown in FIG. 2, the left and right very small pawl portions 24 have a shape that extends obliquely downward from the outer peripheral edge portion of the engaging head portion 23 toward an end portion thereof in a protrusion direction with decreasing distance to the base portion 10. Each very small pawl portion 24 is formed with a very small size such that a pawl width dimension (pawl-side-wall-surface-to-pawl-side-wall-surface interval) at a base end portion where each very small pawl portion 24 is connected to the engaging head portion 23 is less than or equal to ½ of the length of the boundary portion 25 when the engaging element 20 is seen from the direction orthogonal to the up-down direction, preferably, less than or equal to ⅓ of the length of the boundary portion 25 when the engaging element 20 is seen from the direction orthogonal to the up-down direction, and more preferably less than or equal to ⅕ of the length of the boundary portion 25 when the engaging element 20 is seen from the direction orthogonal to the up-down direction.

By providing each engaging element 20 with the very small pawl portions 24 above, when the loop members are engaged with the surface fastener 1, since the loop members engaged with the engaging elements 20 are caught by the very small pawl portions 24, it is possible to make it unlikely for the loops to be separated from the engaging elements 20. In addition, by forming the very small pawl portions 24 to be small with respect to each engaging head portion 23, it is possible to make small the effect that the formation of the very small pawl portions 24 has on the tactile feel or feel with respect to an upper surface side of the surface fastener 1.

Next, a method of manufacturing the surface fastener 1 according to the above-described embodiment is described.

Figure 3:
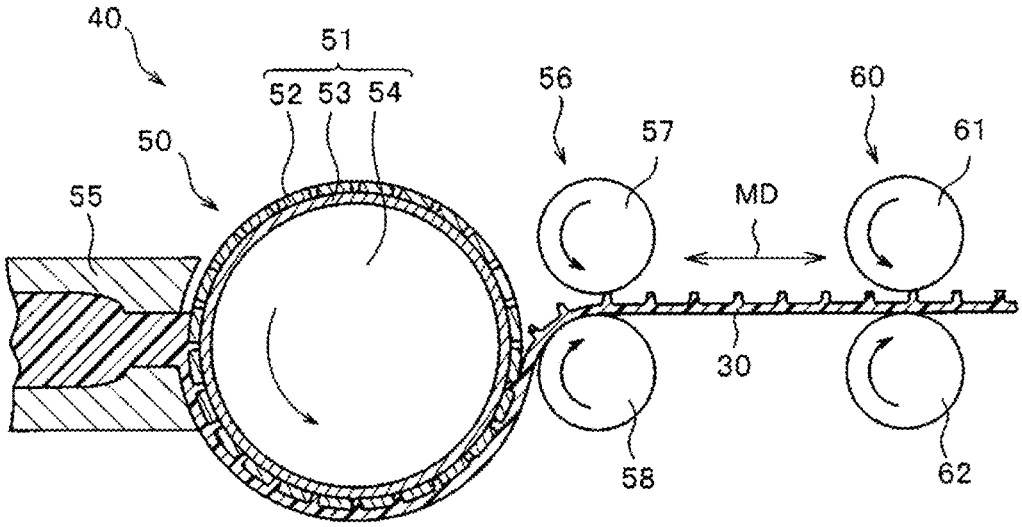
FIG. 3 is a schematic view schematically illustrating a manufacturing apparatus that manufactures the surface fastener shown in FIG. 1.
Figure 4:
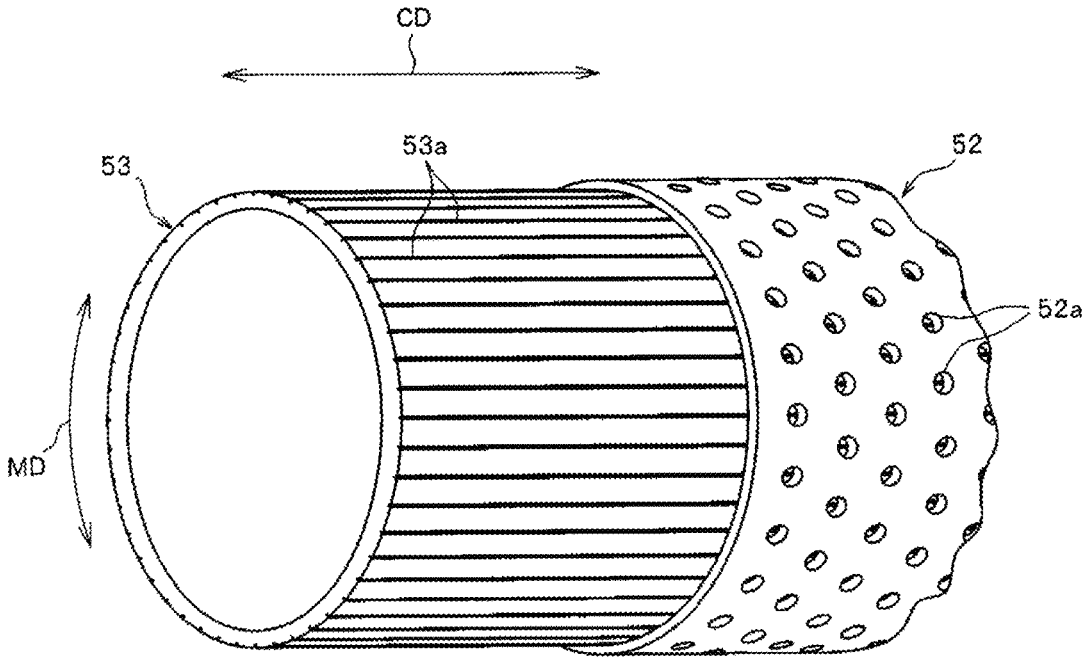
FIG. 4 is a perspective view schematically showing an outer cylindrical body and an inner cylindrical body that are disposed in a primary molding device of the manufacturing apparatus shown in FIG. 3.

The surface fastener 1 shown in FIGS. 1 and 2 is manufactured by using the manufacturing apparatus 40 shown in FIG. 3. The manufacturing apparatus 40 includes the primary molding device 50 that performs a primary molding step and a heating pressing device (secondary molding device) 60 that performs a secondary molding step of pressing and molding the primary molded body 30 molded in the primary molding step.

The primary molding device 50 includes a die wheel 51 that is driven and rotated in one direction (in the drawing, a counterclockwise direction), a supply nozzle portion 55 that is disposed to face a peripheral surface of the die wheel 51 and continuously pushes out a molten synthetic resin material (or causes the molten synthetic resin material to flow out), and a pickup roller 56 that is disposed downstream with respect to the supply nozzle portion 55 in a rotation direction of the die wheel 51.

The die wheel 51 includes a circular cylindrical outer cylindrical body (outer sleeve) 52, which is a die, a circular cylindrical inner cylindrical body (inner sleeve) 53 that is disposed in close contact with an inner side of the outer cylindrical body 52, and a rotational driving roller 54 that rotates the outer cylindrical body 52 and the inner cylindrical body 53 in one direction. A cooling jacket (not shown) that allows a cooling liquid to circulate is provided inside the rotational driving roller 54.

A plurality of through holes 52*a* that extend from an outer peripheral surface to an inner peripheral surface of the outer cylindrical body 52 are formed in the outer cylindrical body 52 as cavities for molding primary stem portions 32 (described below) of the primary molded body 30. The positions of formation of the plurality of through holes 52*a* correspond to the positions where the engaging elements 20 are disposed in the surface fastener 1 to be manufactured. Each through hole 52*a* has a truncated conical shape in which its circular shape in the outer peripheral surface of the outer cylindrical body 52 is larger than its circular shape in the inner peripheral surface of the outer cylindrical body 52, or has a substantially truncated conical shape.

A plurality of recessed groove portions (recessed portions) 53*a* are formed in an outer peripheral surface of the inner cylindrical body 53. Each recessed groove portion 53*a* is recessed in a straight line along a direction parallel to a central axis of the inner cylindrical body 53 (the orthogonal direction CD) so as to have a size that allows molten synthetic resin to flow into each recessed groove portion 53*a*. The recessed groove portions 53*a* are formed at a fixed interval along a peripheral direction of the inner cylindrical body 53 (the machine direction MD). When the die wheel 51 is assembled, at least portions of the recessed groove portions 53*a* of the inner cylindrical body 53 are provided so as to intersect with outer peripheral edges of the through holes 52*a* formed in the inner peripheral surface of the outer cylindrical body 52. Note that a plurality of recessed portions having shapes and sizes differing from those of the recessed groove portions 53*a* may be provided in the outer peripheral surface of the inner cylindrical body 53.

The die wheel 51 may be such that the outer cylindrical body 52 is directly attached to the rotational driving roller 54 without being provided with the inner cylindrical body 53. In this case, the inner peripheral surface of the outer cylindrical body 52 includes recessed portions that are connected to the outer peripheral edge portions of the through holes 52*a*. Each recessed portion is recessed so as to have a size that allows molten synthetic resin to flow into each recessed portion. Alternatively, recessed portions may be formed in a surface of the rotational driving roller 54 that the outer cylindrical body 52 contacts. The recessed portions of the rotational driving roller 54 contact the outer peripheral edge portions of the through holes 52*a* in the inner peripheral surface of the outer cylindrical body 52, and allow molten synthetic resin to flow.

The pickup roller 56 includes an upper nipping roller 57 and a lower nipping roller 58, which constitute a pair of nipping rollers, that nip the primary molded body 30, molded at an outer peripheral surface portion of the die wheel 51, from above and below the primary molded body 30, and that pull the primary molded body 30. An outer peripheral surface portion of the upper nipping roller 57 and an outer peripheral surface portion of the lower nipping roller 58 are each provided with a surface layer (not shown) formed of elastomer, such as polyurethane elastomer.

The heating pressing device 60 includes a pair of upper and lower pressing rollers (calender rollers) 61 and 62, that are disposed on a downstream side of the pickup roller 56. The upper pressing roller 61 and the lower pressing roller 62 are disposed apart from each other with a predetermined interval therebetween and opposite to each other. It is possible to adjust the interval between the upper pressing roller 61 and the lower pressing roller 62 by height adjusting means (not shown).

The upper pressing roller 61 includes a heating source (not shown) in the inside thereof, and is formed such that the surface temperature (heating temperature) of the upper pressing roller 61 is controllable, that is, the heating temperature of the upper pressing roller 61 is settable to a required temperature. Note that, in the present invention, the heating pressing device 60 only needs to include an upper roller that, as described below, comes into contact with a primary element 31 of the primary molded body 30 and heats and presses at least a part of the primary element 31, and thus the structure of the heating pressing device 60 is not particularly limited.

When the manufacturing apparatus 40, such as that described above, including the primary molding device 50 and the heating pressing device 60 is used to manufacture the surface fastener 1, first, the primary molding step of molding the primary molded body 30 by the primary molding device 50 is performed. In the primary molding step, molten material including thermoplastic resin is continuously supplied toward the outer peripheral surface of the rotating die wheel 51 from the supply nozzle portion 55.

In the primary molding step in the present embodiment, as a supply material that is supplied to the die wheel 51 from the supply nozzle portion 55, a material including a thermoplastic resin formed from a mixture of a plant-derived resin and a fossil-resource-derived resin is used.

To specifically describe the thermoplastic resin included in the supply material, in the present embodiment, as described above, as the plant-derived resin of the thermoplastic resin, plant-derived polyethylene is used, and, as the fossil-resource-derived resin, petroleum-derived polypropylene is used. In the present embodiment, when the thermoplastic resin is defined as being 100 parts by weight, the thermoplastic resin includes 50 parts by weight of the plant-derived polyethylene and 50 parts by weight of the petroleum-derived polypropylene.

Note that, in the present embodiment, the mixture proportion of the plant-derived polyethylene and the petroleum-derived polypropylene is not limited and is changeable. When the mixture proportion of the resins is to be changed, it is preferable that the proportion of the plant-derived polyethylene be changed within a range of greater than or equal to 25 parts by weight and less than 100 parts by weight. It is preferable that the proportion of the petroleum-derived polypropylene be changed within a range of greater than 0 parts by weight and less than or equal to 75 parts by weight.

In the present embodiment, the material of which the surface fastener 1 is made may include, in addition to the thermoplastic resin, an additive substance, such as, for example, a lubricant or a pigment. In addition, by using the additive substance, the MFR of the plant-derived resin and the MFR of the fossil-resource-derived resin may be adjusted. In the case in which the additive substance is used, when the thermoplastic resin is defined as being 100 parts by weight, it is preferable that the additive substance be included in the thermoplastic resin by a proportion of less than or equal to 10 parts by weight.

In this case, the plant-derived polyethylene of the thermoplastic resin has an MFR of 5 g/10 min to 30 g/10 min, and a flexural modulus of 800 MPa to 2300 MPa. In addition, the petroleum-derived polypropylene has an MFR of 5 g/10 min to 60 g/10 min, and a flexural modulus of 600 MPa to 2300 MPa.

As a result of the MFR of the plant-derived polyethylene being greater than or equal to 5 g/10 min and the MFR of the petroleum-derived polypropylene being greater than or equal to 5 g/10 min, when an upper end portion of the primary element 31 is to be heated and pressed in the secondary molding step described below, it is possible to soften a part of the primary element 31 at a predetermined heating temperature and easily deform the part of the primary element 31. Further, it is possible to easily form the very small pawl portions 24 on the outer peripheral edge portion of each engaging head portion 23.

As a result of the MFR of the plant-derived polyethylene being less than or equal to 30 g/10 min and the MFR of the petroleum-derived polypropylene being less than or equal to 60 g/10 min, when the primary element 31 has been heated/pressed in the secondary molding step, it is possible to suppress occurrence of sudden deformation in the primary element 31 and to stabilize the shape of each engaging element 20.

As a result of the flexural modulus of the plant-derived polyethylene being greater than or equal to 800 MPa and the flexural modulus of the petroleum-derived polypropylene being greater than or equal to 600 MPa, it is possible to suppress occurrence of sudden deformation in the primary element 31 in the secondary molding step and to stabilize the shape of each engaging element 20. Further, since the rigidity of each engaging element 20 is properly ensured, it is possible to prevent reduction in the engaging strength (peel strength) of the surface fastener 1 caused by the rigidity of each engaging element 20.

As a result of the flexural modulus of the plant-derived polyethylene being less than or equal to 2300 MPa and the flexural modulus of the petroleum-derived polypropylene being less than or equal to 2300 MPa, it is possible to properly and quickly deform the primary element 31 in the secondary molding step. Therefore, it is possible to stably form each engaging element 20 such that the rear surface angle θ of the engaging head portion 23 has a magnitude within the range above.

Figure 5:
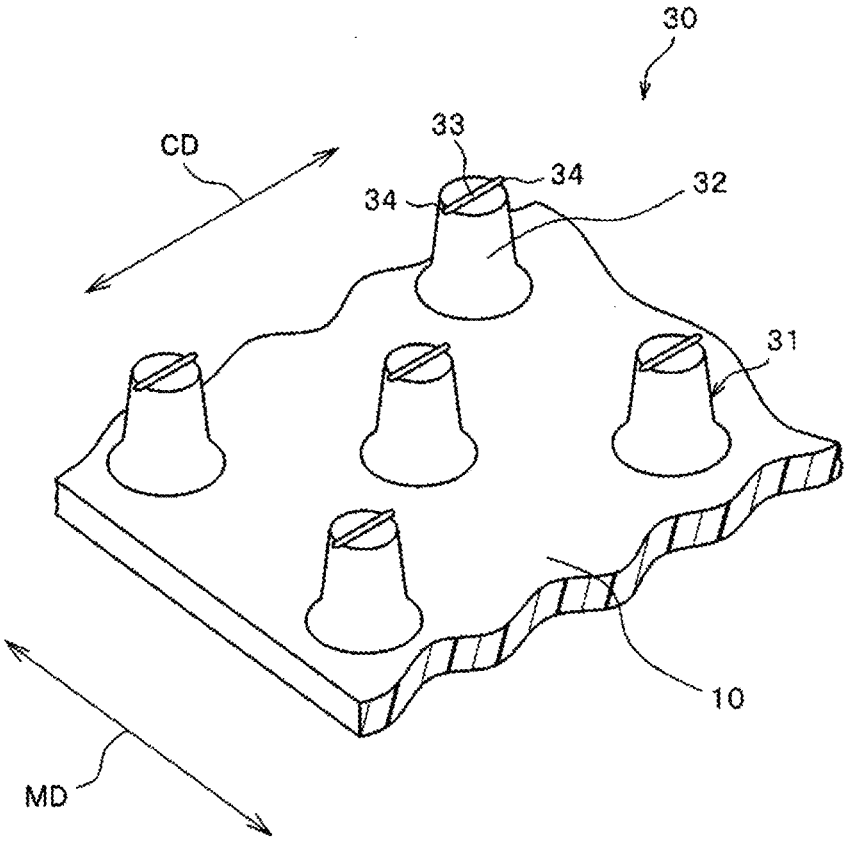
FIG. 5 is a perspective view schematically showing a primary molded body that is molded in a primary molding step.

In the primary molding step using the primary molding device 50, when the material including the thermoplastic resin above is continuously supplied in a molten state from the supply nozzle portion 55, the primary molded body 30 in which a plurality of the primary elements 31 (may also be called temporary elements), like that shown in FIG. 5, protrude from the upper surface of the base portion 10 is molded. At this time, the material that is supplied from the supply nozzle portion 55 is heated at a temperature that allows both the plant-derived polyethylene and the petroleum-derived polypropylene to melt. In addition, by supplying the molten material to the die wheel 51, the base portion 10 is continuously formed along the machine direction MD between the supply nozzle portion 55 and the die wheel 51. Further, the base portion 10 is molded and, by using the outer cylindrical body 52 and the inner cylindrical body 53 of the die wheel 51, the plurality of the primary elements 31 are integrally molded with the base portion 10. Note that the primary molding device may be formed to have, for example, a structure in which a molten synthetic resin material is supplied from the supply nozzle portion toward a gap between two opposing die wheels that face each other. In this case, the base portion 10 is formed between the pair of die wheels, and the primary elements are formed by cavities provided in one of the die wheels.

The primary molded body 30 that is molded by the primary molding device 50 includes the thin-plate-shaped base portion 10 and the plurality of the primary elements 31 that protrude from the upper surface of the base portion 10. The base portion 10 of the primary molded body 30 becomes as it is the base portion 10 of the surface fastener 1. The primary elements 31 by being pressed and molded in the secondary molding step are deformed into the engaging elements 20. Each primary element 31 includes a truncated conical or a substantially truncated conical primary stem portion 32 that stands upward from the base portion 10, a rod-shaped rib portion 33 that bulges upward from an upper surface of the primary stem portion 32, and two protruding portions (primary very small pawl portions) 34 that are integrally formed with the rib portion 33 and that protrude outward of the primary stem portion 32. Note that each primary element 31 need not include a rod-shaped rib portion 33 that bulges upward from the upper surface of the primary stem portion 32. In this case, each primary element 31 includes at an upper end portion of the primary stem portion 32 two protruding portions (primary very small pawl portions) 34 that protrude outward from an outer peripheral edge portion of the primary stem portion 32.

In each primary element 31, the rib portion 33 and the protruding portions 34 are molded when, in the primary molding step, synthetic resin flows into the recessed groove portions 53*a* of the inner cylindrical body 53 from the through holes 52*a* of the outer cylindrical body 52 and the synthetic resin flows along the recessed groove portions 53*a* up to portions existing beyond the through holes 52*a*. In this case, each rib portion 33 is locally formed on the upper surface of the corresponding primary stem portion 32 along the orthogonal direction CD. The two protruding portions 34 protrude outward of the corresponding primary stem portion 32 from respective end portions of the corresponding rib portion 33.

In the primary molding step, the primary molded body 30 above is molded when the molten material including the thermoplastic resin rotates through an angle of 180 degrees while being carried and cooled on an outer peripheral surface of the die wheel 51. Then, the primary molded body 30 is continuously separated from the outer peripheral surface portion of the die wheel 51 by the pickup roller 56.

Next, the primary molded body 30 that has been separated from the die wheel 51 is transported toward the heating pressing device 60 that performs the secondary molding step, and is introduced between the upper pressing roller 61 and the lower pressing roller 62 of the heating pressing device 60.

In this secondary molding step, the base portion 10 of the primary molded body 30 is supported from below the base portion 10 by the lower pressing roller 62. As a result of bringing the upper pressing roller 61 into contact with the upper end portion of each primary element 31 while rotating the upper pressing roller 61, the upper pressing roller 61 heats and softens at least the upper end portion of each primary element 31 and presses the at least upper end portion of each primary element 31 from thereabove. Therefore, the upper end portion of the primary stem portion 32, the rib portion 33, and the protruding portions 34 of each primary element 31 are squashed and thermally deformed to mold the engaging head portions 23 and the very small pawl portions 24.

At this time, the heating temperature of the upper pressing roller 61 is set to be higher than or equal to a temperature that is 35° C. lower than a temperature in which a weighted average of the melting points of the respective synthetic resins included in the thermoplastic resin is obtained (hereunder may be called weighted average temperature), and to be lower than or equal to a temperature that is 18° C. lower than the weighted average temperature. That is, in the secondary molding step of the present embodiment, the heating temperature of the upper pressing roller 61 is set to be a proper temperature in accordance with components of the material that is supplied from the supply nozzle portion 55.

As described above, when, for example, the thermoplastic resin includes 50 parts by weight of the plant-derived polyethylene (melting point is 131° C.) and 50 parts by weight of the petroleum-derived polypropylene (melting point is 168° C.), the temperature in which the weighted average of the melting points of the resins of the thermoplastic resin is obtained is 149.5° C. Since the melting point of the plant-derived polyethylene is lower than the melting point of the petroleum-derived polypropylene, when the proportion of the plant-derived polyethylene included in the thermoplastic resin is larger than the proportion of the petroleum-derived polypropylene included in the thermoplastic resin, the weighted average temperature is lower than 149.5° C.

Therefore, the heating temperature of the upper pressing roller 61 is set at 114.5° C. to 131.5° C. Specifically, the heating temperature of the upper pressing roller 61 in the present embodiment is set at 118° C. (see Example 1 described below). Here, the heating temperature of the upper pressing roller 61 is the temperature at a roller surface (outer peripheral surface) of the upper pressing roller 61 that is heated by a heating source (not shown). Note that, in calculating the weighted average temperature of the melting points of the thermoplastic resin, when the thermoplastic resin is defined as being 100 parts by weight, the melting point of an additive substance included by a proportion of less than or equal to 10 parts by weight is not considered. The melting points of the resins of the thermoplastic resin can be calculated by DSC measurement.

When the heating temperature of the upper pressing roller 61 is higher than or equal to the temperature that is 35° C. lower than the temperature in which the weighted average of the melting points of the synthetic resins is obtained, it is possible to properly heat the upper end portion of each primary element 31 and to smoothly form the engaging head portions 23 and the very small pawl portions 24. Further, the rear surface angle θ of the head-portion rear surface 23*c* of each engaging head portion 23 can be stably made less than or equal to 120 degrees. When the heating temperature of the upper pressing roller 61 is lower than or equal to the temperature that is 18° C. lower than the temperature in which the weighted average of the melting points of the synthetic resins is obtained, it is possible to prevent overheating of the primary elements 31 when the upper pressing roller 61 contacts the primary elements 31 and to stably mold each engaging element 20 including the engaging head portion 23.

In the present embodiment, since, as the material of the surface fastener 1, a mixture of the plant-derived polyethylene whose MFR and flexural modulus are adjusted within the predetermined ranges and the petroleum-derived polypropylene whose MFR and flexural modulus are adjusted within the predetermined ranges is used, it is possible to properly ensure the strength of each engaging element 20.

By performing the secondary molding step above, the surface fastener 1 including the plurality of engaging elements 20, such as that shown in FIGS. 1 and 2, is manufactured. The surface fastener 1 that is long in the machine direction MD that is obtained by performing the secondary molding step is, for example, wound up in the form of a roll by a collecting roller or the like, and collected. Alternatively, the surface fastener 1 may be collected after being transported toward a cutting section (not shown) and being cut to a predetermined width dimension and/or a length dimension at the cutting section.

In the surface fastener 1 of the present embodiment, since the plurality of engaging elements 20 each including at least the stem portion 22 and the engaging head portion 23 are stably formed, it is possible to stably engage the loop members therewith. Since the surface fastener 1 includes the plant-derived polyethylene, which is a plant-derived resin, it is possible to reduce the use of fossil-resource-derived resin to thereby reduce the load on the environment. Further, it is possible to expect the effects of, for example, reducing emission of greenhouse gases and suppressing or preventing environmental pollution. In particular, when the surface fastener 1 includes, in addition to the plant-derived polyethylene, the petroleum-derived polypropylene, the surface fastener 1 can have the proper strength capable of withstanding use, and manufacturing costs of the surface fastener 1 can be suppressed from increasing.

In the surface fastener 1 of the present embodiment, in the secondary molding step of the manufacturing process, the heating temperature of the upper pressing roller 61 is set lower than or equal to the temperature that is 18° C. lower than the temperature in which the weighted average of the melting points of the synthetic resins is obtained. Therefore, even if the plant-derived polyethylene is included in the thermoplastic resin, it is possible to stably form the engaging elements 20 each including the engaging head portion 23 and the very small pawl portions 24. Consequently, it is possible to firmly engage the surface fastener 1 of the present embodiment with the loop members.

Further, in the surface fastener 1 of the present embodiment, in the secondary molding step of the manufacturing process, the heating temperature of the upper pressing roller 61 is set to be higher than or equal to the temperature that is 35° C. lower than the temperature in which the weighted average of the melting points of the synthetic resins is obtained. Therefore, in the secondary molding step, it is possible to stably thermally deform the primary elements 31 and form the engaging elements 20. Moreover, since the rear surface angle θ of each engaging head portion 23 can be stably made less than or equal to 120 degrees, it is possible to effectively increase the engaging strength of the surface fastener 1 with respect to the loop members.

EXAMPLES

The present invention is described in more detail below with reference to examples.

Example 1 to Example 3

As Examples 1 to 3, surface fasteners 1 were manufactured by using the manufacturing apparatus 40 described in the embodiment above. In Examples 1 to 3, as a supply material to be supplied to the die wheel 51 from the supply nozzle portion 55, a material including, when thermoplastic resin is defined as being 100 parts by weight, 50 parts by weight of plant-derived polyethylene, 50 parts by weight of petroleum-derived polypropylene, and 4 parts by weight of pigment, was used. The melting points of the plant-derived polyethylene and the petroleum-derived polypropylene used in Examples 1 to 3 were calculated by DSC measurement (DSC7000X manufactured by Hitachi High-Tech Science Corporation).

In this case, the plant-derived polyethylene used has an MFR of 20 g/10 min (measurement temperature is 190° C.), a flexural modulus of 1250 MPa, and a melting point of 131° C. The petroleum-derived polypropylene has an MFR of 10 g/10 min (measurement temperature is 230° C.), a flexural modulus of 2000 MPa, and a melting point of 168° C. As the pigment, a white pigment whose main component being polypropylene and including titanium oxide was used.

Table 1 below shows, in addition to the components of the materials of Examples 1 to 3, the results of calculations of "the weighted average temperature of the melting points of synthetic resins" for each material, "the heating temperature of the upper pressing roller 61" in the secondary molding step, and "the difference between the calculated result of the weighted average temperature and the heating temperature of the upper pressing roller 61".

As shown in Table 1, in Examples 1 to 3, the primary molding step was performed by using the same material to prepare primary molded bodies 30. Then, the secondary molding step was performed on the obtained primary molded bodies 30 with the heating temperature of the upper pressing roller 61 being set at different temperature values, and the surface fasteners 1 of Examples 1 to 3 were manufactured.

After manufacturing each surface fastener 1, each of the obtained surface fasteners 1 was cut in a direction orthogonal to the machine direction MD, and the engaging elements 20 of each surface fastener 1 were photographed from one side (forward side) in the machine direction MD. Further, from the images of the photographed engaging elements 20, the shape of each engaging element 20 was observed and the rear surface angle θ of each engaging head portion 23 was measured. The values of the rear surface angles θ measured in Examples 1 to 3 are shown again in Table 1 below.

Comparative Example

As a comparative example, a primary molding step was performed by using a material that was the same as that used in Examples 1 to 3 to prepare a primary molded body 30. Then, a secondary molding step in which the heating temperature of the upper pressing roller 61 was set to be 133° C., being higher than 131.5° C. (="temperature being 18° C. lower than the weighted average temperature of the melting points of synthetic resins"), was performed on the obtained primary molded body 30 to manufacture a surface fastener of the comparative example.

After manufacturing the surface fastener of the comparative example, as in Examples 1 to 3 above, the shape of each engaging element 20 was observed.

TABLE 1

| Item | | Units | Example 1 | Example 2 | Example 3 | Comparative Example |
|---|---|---|---|---|---|---|
| Material | Plant-Derived Polyethylene | Parts By Weight | 50 | 50 | 50 | 50 |
| | Petroleum-Derived Polypropylene | Parts By Weight | 50 | 50 | 50 | 50 |
| | Pigment | Parts By Weight | 4 | 4 | 4 | 4 |
| Melting Point of Plant-Derived Polyethylene | | ° C. | 131 | 131 | 131 | 131 |
| Melting Point of Petroleum-Derived Polypropylene | | ° C. | 168 | 168 | 168 | 168 |
| Weighted Average Temperature of Melting Points | | ° C. | 149.5 | 149.5 | 149.5 | 149.5 |
| Heating Temperature of Upper Pressing Roller | | ° C. | 118 | 122 | 114 | 133 |
| "Weighted Average Temperature − Heating Temperature" Value | | ° C. | 31.5 | 27.5 | 35.5 | 16.5 |
| Rear Surface Angle θ | | ° | 118 | 90 | 133 | Processing Failure |

As a result of observing the shape of each engaging element 20 in Examples 1 to 3, in the surface fasteners 1 of Examples 1 to 3 in which, in the secondary molding step, the heating temperature of the upper pressing roller 61 was set lower than or equal to 131.5° C. (="temperature being 18° C. lower than the weighted average temperature of the melting points of synthetic resins"), it was confirmed that each engaging element 20 had a stem portion 22 having a substantially truncated conical shape, an engaging head portion 23 integrally formed with an upper end of the stem portion 22, and two very small pawl portions 24 protruding outward from an outer peripheral surface portion of the engaging head portion 23, and that, in plan view of each engaging element 20, the engaging head portion 23 was such that at least a part of the engaging head portion 23 was formed with a shape protruding outward with respect to the upper end of the stem portion 22. Therefore, it has been found that the surface fasteners 1 of Examples 1 to 3 are smoothly engageable with loop members, and that, when, for example, the surface fasteners 1 are used in disposable diaper products, it can be ensured that the surface fasteners 1 have an engaging strength with respect to the loop members so as to be suitable for use in such products.

Further, in the surface fasteners 1 of Examples 1 and 2, in which the heating temperature of the upper pressing roller 61 was set at a temperature higher than 114.5° C. (="temperature being 35° C. lower than the weighted average temperature of the melting points of synthetic resins"), it was confirmed that the rear surface angle θ of each engaging element 20 was less than or equal to 120 degrees. Therefore, in the surface fasteners 1 of Examples 1 and 2, it has been found that their engaging strengths were higher than the engaging strength of the surface fastener 1 of Example 3 whose rear surface angle θ was larger than 120 degrees.

On the other hand, in the surface fastener 1 of the comparative example in which the heating temperature of the upper pressing roller 61 was set at a temperature higher than 131.5° C., it was confirmed that the engaging head portions 23 having a shape protruding outward with respect to the upper ends of the stem portions 22 were not properly formed. Therefore, it has been found that the surface fastener 1 of the comparative example is not capable of engaging with loop members, or that, even if the surface fastener 1 of the comparative example has engaged with loop members, an engaging strength suitable for use in disposable diaper products cannot be obtained.

REFERENCE SIGNS LIST

1 surface fastener
10 base portion
20 engaging element
21 engaging element row
22 stem portion
23 engaging head portion
23*a* head-portion top end surface
23*b* outer peripheral side surface
23*c* head-portion rear surface
24 very small pawl portion
25 boundary portion
26 imaginary line
30 primary molded body
31 primary element
32 primary stem portion
33 rib portion
34 protruding portion (primary very small pawl portion)
40 manufacturing apparatus
50 primary molding device
51 die wheel
52 outer cylindrical body (outer sleeve)
52*a* through hole
53 inner cylindrical body (inner sleeve)
53*a* recessed groove portion (recessed portion)
54 rotational driving roller
55 supply nozzle portion
56 pickup roller
57 upper nipping roller
58 lower nipping roller
60 heating pressing device (secondary molding device)
61 upper pressing roller
62 lower pressing roller
CD orthogonal direction
MD machine direction
θ rear surface angle

The invention claimed is:

1. A surface fastener comprising a base portion and a plurality of engaging elements that are provided on one surface of the base portion, each engaging element including a stem portion that extends upward from the base portion and an engaging head portion that is integrally formed with an upper end of the stem portion, wherein the base portion and the engaging elements include a thermoplastic resin that at least partially includes a plant-derived resin, the plant-derived resin has a melt flow rate of 5 g/10 min or more and 30 g/10 min or less, and a flexural modulus of 800 MPa or more and 2300 MPa or less, and in plan view of each of the engaging elements, the engaging head portion is such that at least a part of the engaging head portion has a shape that protrudes outward with respect to the upper end of the stem portion.

2. The surface fastener according to claim 1, wherein each of the engaging head portions has a head-portion top end surface that faces upward, an outer peripheral side surface that inclines or curves downward from an outer peripheral edge of the head-portion top end surface, and a head-portion rear surface that is disposed between the outer peripheral side surface and the upper end of the stem portion, and a rear surface angle between a portion of the head-portion rear surface that extends from the upper end of the stem portion and an imaginary line that is extended downward from the upper end of the stem portion is less than or equal to 120 degrees.

3. The surface fastener according to claim 1, wherein the thermoplastic resin includes plant-derived polyethylene by a proportion of 25 parts by weight to 100 parts by weight with respect to 100 parts by weight of the thermoplastic resin.

4. The surface fastener according to claim 1, wherein the thermoplastic resin is formed from a mixture of plant-derived polyethylene and fossil-resource-derived polypropylene, the plant-derived polyethylene is included in the thermoplastic resin by a proportion of greater than or equal to 25 parts by weight and less than 100 parts by weight with respect to 100 parts by weight of the thermoplastic resin, and the fossil-resource-derived polypropylene has a melt flow rate of 5 g/10 min or more and 60 g/10 min or less, and a flexural modulus of 600 MPa or more and 2300 MPa or less.

5. The surface fastener according to claim 1, wherein each of the engaging elements is provided with at least one very small pawl portion that protrudes from an outer peripheral edge portion of the engaging head portion.

6. The surface fastener according to claim 5, wherein the at least one very small pawl portion extends downward toward the base portion from the outer peripheral edge portion of the engaging head portion corresponding thereto.

* * * * *